United States Patent [19]

Higashi et al.

[11] Patent Number: 4,790,576

[45] Date of Patent: Dec. 13, 1988

[54] MAGNET CATCH

[75] Inventors: Chiyokazu Higashi, Saitama; Takayuki Tajima, Tokyo, both of Japan

[73] Assignee: Kabushiki Kaisha Murakoshi Seiko, Tokyo, Japan

[21] Appl. No.: 164,850

[22] Filed: Mar. 7, 1988

[30] Foreign Application Priority Data

Jun. 26, 1987 [JP] Japan ..... 62-98302[U]

[51] Int. Cl.[4] ..... E05C 17/56

[52] U.S. Cl. ..... 292/251.5; 292/DIG. 60

[58] Field of Search ..... 292/251.5, 140, 341.18, 292/DIG. 60

[56] References Cited

U.S. PATENT DOCUMENTS 160,285 3/1875 Royle ..... 292/140

3,016,563 1/1962 De Jong ..... 292/251.5 X

FOREIGN PATENT DOCUMENTS 1553568 6/1969 Fed. Rep. of Germany ... 292/251.5

*Primary Examiner*—Richard E. Moore

*Attorney, Agent, or Firm*—James E. Nilles

[57] ABSTRACT

A magnet catch wherein a magnet assembly is installed in a case from the front opening in such a way that it can be moved back and forth, an adjust cam is secured to an adjust spindle rotatably mounted to one side portion of the case and disposed in a direction perpendicular to that in which the magnet assembly advances and retracts, a cam groove is formed on the adjust cam in such a manner that the cam groove radius from the adjust spindle as the rotating center continuously changes, and a cam pin projecting from the magnet assembly is engaged with the cam groove.

2 Claims, 2 Drawing Sheets

MAGNET CATCH

BACKGROUND OF THE INVENTION

1. Field of the Invention

The present invention relates to a magnet catch that holds a door of furniture to a furniture body by the attraction of the magnet.

2. Description of the Prior Art

Furniture that employs a magnet catch to enable the front opening of a furniture body to be closed and opened by a door has a structure in which an iron piece is attached to the inner side of the door at an end thereof and a magnet catch is attached to the inner side of the front opening section of the furniture body so that when the door is closed the iron piece approaches the magnet catch and is attracted by it to hold the door closed. This structure has the following drawback. Depending on the position of the magnet catch on the furniture body, a gap between the magnet catch and the iron piece may change. When, for instance, the gap is large, the attraction between them will not be strong enough to keep the door closed. And when the magnet catch projects forward too much from the furniture body, the door cannot completely close the front opening of the furniture body.

To solve this problem, as described in the Japanese Utility Model Publication No. 6927/1980, a magnet catch has been proposed in which a magnet assembly is made movable back and forth with respect to a case of the magnet catch to adjust an attraction gap between the magnet assembly and an iron piece on a door.

In detail this magnet catch has the following structure. The magnet assembly is installed in the case from one side of the case and is made movable back and forth in the case. The magnet assembly has a slot perpendicular to a direction in which the assembly moves. An adjust spindle is rotatably supported on the case. Inserted in the slot of the magnet assembly is an eccentric shaft section that rotates at a position off the rotating center of the adjust spindle. As the adjust spindle is turned for adjustment, the eccentric shaft section of the adjust spindle moves through the slot of the magnet assembly, advancing or retracting the magnet assembly in the case thereby adjusting the position of the magnet assembly relative to the iron piece.

The magnet assembly of the magnet catch is subjected to a pressing force caused by the iron piece of the closing door striking the assembly. The magnet assembly also is subjected to a pulling force when the iron piece of the opening door parts from it.

With the above-mentioned conventional structure, when an external force is applied to the magnet assembly during the opening and closing action of the door, the adjust spindle is easily rotated causing the magnet assembly to move with respect to the case. To prevent this, the conventional magnet catch has made the rotating contact surface between the adjust spindle and the case a frictional surface. If the friction is large, the rotation of the adjust spindle becomes difficult. However, a small friction cannot prevent the adjust spindle from being easily rotated by the external force.

SUMMARY OF THE INVENTION

The present invention has been accomplished with a view to overcoming the above drawbacks and it is an object of the invention to provide a magnet catch that prevents a magnet assembly from being moved by an external force.

The magnet catch of this invention comprising a case in which a magnet assembly is installed from the front opening in such a way that the magnet assembly can be moved back and forth, an adjust spindle rotatably supported on one side portion of the case that is perpendicular to a direction of the movement of the magnet assembly, a projecting cam pin located either on the front or rear side of the adjust spindle with respect to the moving direction of the magnet assembly, an adjust cam secured to the adjust spindle so that they rotate as one, and a cam groove with which the cam pin engages and which is formed in such a way that the radial distance of the cam groove from the adjust spindle as the rotating center continually changes.

The operation of the magnet catch of the invention is as follows. As the adjust spindle is turned for adjustment, the cam pin projecting from the magnet assembly is moved forward or backward by the cam groove of the adjust cam that rotates with the adjust spindle, advancing or retracting the magnet assembly in the case. When an external force is applied to the magnet assembly in the direction of the advancing and retracting movement of the magnet assembly pushing cam pin of the magnet assembly against the cam groove of the adjust cam, the force does not act on the adjust cam as a rotating force because the direction of that push corresponds with the direction of the cam groove radius from the adjust spindle as the rotating center of the adjust cam.

The above and other objects and features of this invention will be explained in the following by referring to the attached drawings.

DESCRIPTION OF THE PREFERRED EMBODIMENT

Figure 3:
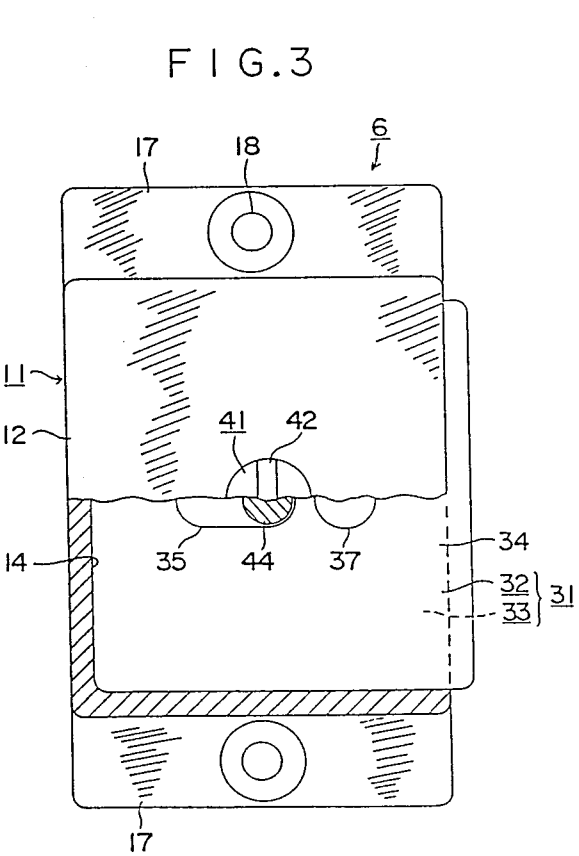
FIG. 3 is a plan view of the magnet catch partially cross-sectioned.
Figure 1:
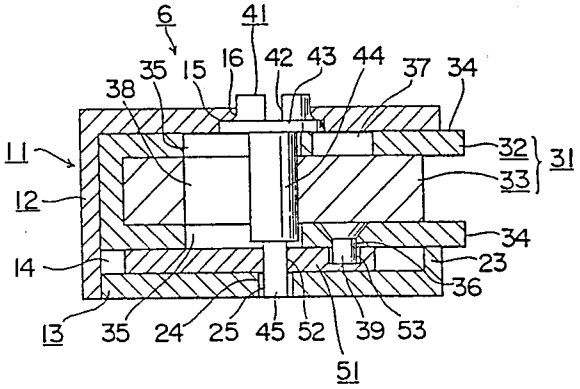
FIG. 1 is a cross section showing one embodiment of a magnet catch of this invention.
Figure 2:
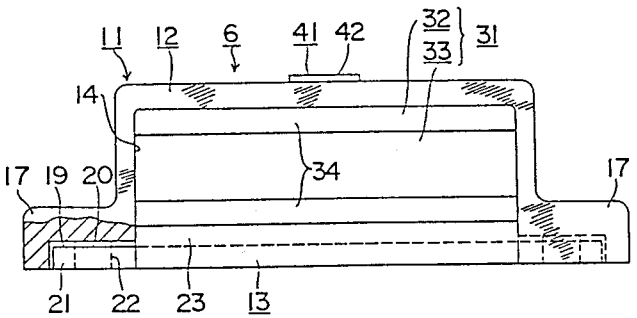
FIG. 2 is a front view of the magnet catch partially cross-sectioned.
Figure 6:
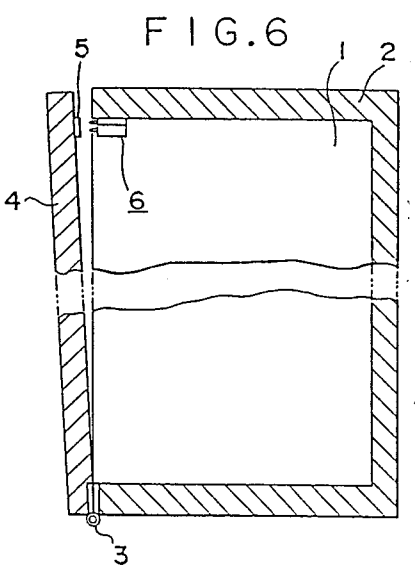
FIG. 6 is a cross section of a piece of furniture showing how the magnet catch works.

FIG. 6 shows a magnet catch of this invention used on a piece of furniture, which has a storage space 1 and an opening at the front. A door 4 is mounted to a furniture body 2 through a hinge 3 so that it can be opened and closed. The door 4 has an iron piece 5 attached to the inside thereof at an opening end. On the front opening section, the furniture body has a magnet catch 6 attached to the inside thereof at a position opposing the iron piece 5.

The magnet catch 6, as shown in FIG. 1 through FIG. 5, has a case 11 which consists of a case body 12 and a case cover 13, both made of synthetic resin. The case body 12 has a storage space 14 with the front and the bottom open. At almost the central portion, the case body 12 has a window hole 16 passing vertically therethrough toward the storage space 14. The window hole 16 is formed with a step 15. The case body 12 also has a flange 17 projecting from each side which has a mounting hole 18 formed vertically therethrough at the center. On each side of the mounting hole 18, the flange 17 has an engagement groove 19 formed at the bottom which communicates with the storage space 14. At the center of the engagement groove 19, an engagement projection 20 is formed protruding downward.

The case cover 13 is fitted to the lower internal part of the storage space 14 of the case 12. The case cover 13 has an engagement projection 21 at each side that fits into the engagement groove 19 of the case body 12. The engagement projections 21 are each formed with an engagement hole 22 that tightly fits over the downward engagement projection 20. The case cover 13 also has its front edge bent upward to form a concealing edge 23. A support hole 24 is formed in the case cover 13 at the position axially corresponding to the window hole 16. The supporting hole 24 has serration 25 formed on the inner circumference thereof as a rotation adjust section.

A magnet assembly 31 is installed from the front into the storage space 14 of the case 11 in such a way that it can be moved forward and backward. The magnet assembly 31 consists of a yoke 32 and a magnet 33. The yoke 32 is shaped like a letter U in cross section lying on its side with its two yoke legs 34 projecting parallelly forward. At almost the central portion, the yoke legs 34 each have a longitudinally extending slot 35 at a position axially corresponding to the window hole 16 and the support hole 24. The lower yoke leg 34 has a pin mounting hole 36 in front of the slot 35. The upper yoke leg 34 has a through hole 37 in front of the slot 35. The magnet 33 is held between the legs 34 of the yoke 32 and has a slot 38 of the same shape as the slot 35 of the yoke leg 34 at the position corresponding to the slot 35. The slot 38 vertically passes through the magnet 33.

Securely installed in the pin mounting hole 36 of the lower yoke leg 34 is a cam pin 39 which is fixed to the hole 36 by a connecting means such as press fit or thread and whose end projects downward from the lower yoke leg 34. The cam pin 39 is pressed into o screwed into the hole 36 through the hole 37 of the upper yoke leg 34.

An adjust spindle 41 is rotatably installed in the case 11, passing through the upper and lower surfaces of the case. The adjust spindle 41 has a turn operation section 42 rotatably fitted in the window hole 16 of the case body 12. The turn operation section 42 is engaged by the front end of a screwdriver for rotation. The turn operation section 42 has a flange 43 at the lower periphery which is rotatably engaged with the support step 15. The adjust spindle 41 has a shaft section 44, circular in cross section, provided under the center of the turn operation section 42. The shaft section 44 passes through the slots 35 of the yoke 32 and the slot 38 of the magnet 33. Another shaft section 45, rectangular in cross section, provided to the lower end of the shaft section 44 is rotatably fitted in the support hole 24 of the case cover 13.

Figure 5:
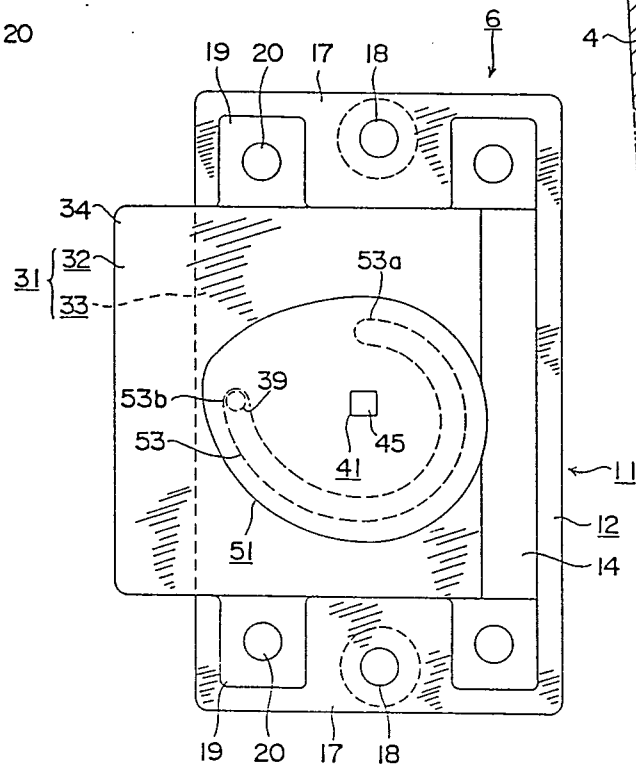
FIG. 5 is a bottom view of the magnet catch of FIG. 4 in operation.
Figure 4:
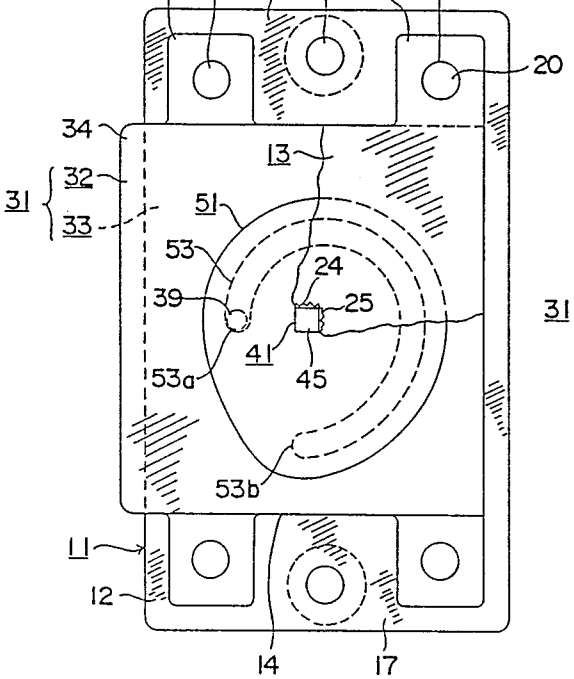
FIG. 4 is a bottom view of the magnet catch with case cover removed.

An adjust cam 51 is installed between the case cover 13 and the yoke 32, and has a rectangular engagement hole 52 formed at almost the central portion thereof, into which the shaft section 45 of the adjust spindle 41 is tightly fitted so that the adjust spindle 41 and the adjust cam 51 rotate as one. The adjust cam 51 also has a cam groove 53 on the upper surface with which the cam pin 39 engages. As shown in FIGS. 4 and 5, the radial distance of the cam groove 53 from the rotating center, i.e., the adjust spindle 41, is shortest at one end **53*a* and gradually increases toward the other end 53*b***.

The magnet catch 6, as shown in FIG. 6, is attached to the inner side of the side plate of the furniture body 2 at the front open end by screws driven into the mounting holes 18 of the flanges 17 of the case body 12. In this mounting condition, it is possible to laterally hold the screwdriver and engage its tip with the operation section 42 of the adjust spindle 41 from inside the furniture body 2 and to turn the adjust spindle 41 to cause the magnet assembly 31 to advance and retract.

When, as shown in FIG. 4, the cam pin 39 is engaged with the end **53*a* of the cam groove 53 of the adjust cam 51, the magnet assembly 31 is retracted into the case 11 with the amount of projection of the yoke legs 34 from the case 11** the smallest.

As the adjust spindle 41 is turned counterclockwise in FIG. 4 to engage the cam pin 39 with the other end **53*b* of the cam groove 53, the radial distance of the cam groove 53 from the adjust spindle 41 increases and the sliding engagement between the cam groove 53 and the cam pin 39 pushes forward the cam pin 39 and the magnet assembly 31, with the result that the yoke legs 34 of the magnet assembly 31 advance from the case 11. When, as shown in FIG. 5, the cam pin 39 engages with the other end 53*b* of the cam groove 53, the magnet assembly 31 advances to the extreme position and the amount of projection from the case 11 of the yoke legs 34 of the magnet assembly 31** becomes the largest.

In this way, by rotating the adjust spindle 41 it is possible to advance or retract the magnet assembly 31 with respect to the case 11 and thereby adjust the amount of projection from the case 11 of the yoke legs 34 of the magnet assembly 31. This in turn allows an easy adjustment on the attraction between the magnet assembly 31 and the iron piece 5 attached to the door, which is adapted to open and close the front of the furniture body 2.

During the opening and closing action of the door 4, the magnet assembly 31 of the magnet catch 6 is applied with a push by the iron piece 5 of the door 4 abutting against the magnet assembly and also with a pull by the same parting from the iron piece 5. When, for instance, the magnet assembly 31 is applied with a force that tends to push it backward, the cam pin 39 pushes back the edge of the cam groove 53 of the adjust cam 51. However, the direction of the push coincides with that of the cam groove radius originating from the adjust spindle 41 as the center of the adjust cam 51, so that the push does not act upon the adjust cam as a rotating force, keeping the magnet assembly 31 from being pushed back into the case 11. Similarly, when the magnet assembly is applied with a pull and the cam pin 39 pulls the cam groove 53 of the adjust cam 51 forward, the adjust cam 51 does not rotate because the pulling direction agrees with that of the radius from the adjust spindle 41 as the center of the cam groove 53. So, the magnet assembly 31 is not pulled from the case 11.

Also, the engagement of the rectangular shaft section 45 of the adjust spindle 41 with the serration 25 of the case cover 13 prevents undesired rotation of the adjust spindle 41 while at the same time allowing a restricted rotation of it during adjustment. This keeps the adjust cam 51 from being rotated and the magnet assembly 31 from being moved after adjustment is made.

While in this embodiment the cam pin 39 is provided to the yoke 32 at a position in front of the adjust spindle 41, it is also possible to install it at the back of the adjust spindle 41. In this case also, application of an external force to the magnet assembly 31 does not cause the adjust cam 51 to rotate.

To summarize, the present invention brings the following advantages. When the adjust spindle is turned for adjustment, the cam pin secured to the magnet assembly is moved back and forth by the cam groove of the adjust cam with which the cam pin is engaged and the magnet assembly is advanced and retracted with respect to the case. On the other hand, when an external force is applied to the magnet assembly in the direction of the magnet assembly adjusting movement, the pushing force of the cam pin of the magnet assembly against the cam groove of the adjust cam does not act upon the adjust cam as the rotating force because the force of the cam pin acts in the same direction as that of the cam groove radius from the adjust spindle as the center. Therefore, the magnet assembly does not move with respect to the case.

What is claimed is:

1. A magnet catch comprising:

a case with an open front;

a magnet assembly installed in the case from the front opening in such a way that it can be moved back and forth;

an adjust spindle rotatably mounted to one side portion of the case and disposed in a direction perpendicular to that in which the magnet assembly advances and retracts;

a cam pin projecting from the magnet assembly either on the front side or the rear side of the adjust spindle with respect to a moving direction of the magnet assembly; and an adjust cam secured to the adjust spindle so that it can rotate with the latter and having a cam groove with which the cam pin engages, the cam groove being formed in such a manner that the cam groove radius from the adjust spindle as the rotating center continuously changes.

2. A magnet catch as set forth in claim 1, wherein the case that rotatably supports the adjust spindle is provided with a rotation adjust section which allows a restricted rotation of the adjust spindle and prevents undesired rotation of it.

* * * * *